United States Patent [19]

Niece

[11] 4,023,682

[45] May 17, 1977

[54] DEVICE FOR SECURING CONTAINERS TO REFRIGERATOR SHELVES

[75] Inventor: Melvin L. Niece, Lakeview, Ohio

[73] Assignee: NBS, Incorporated (Entire), Huntsville, Ohio

[22] Filed: Nov. 5, 1975

[21] Appl. No.: 629,614

[52] U.S. Cl. ..... 211/184; 108/27; 211/43; 211/44

[51] Int. Cl.[2] ..... A47F 7/14

[58] Field of Search ..... 211/11, 40, 42–44, 211/184, 153; 248/302, 214, 215, 175; 108/27, 60, 61; 24/81 CC

[56] References Cited

UNITED STATES PATENTS

| | | | |
|---|---|---|---|
| 1,881,614 | 10/1932 | Irving | 211/11 |
| 2,555,873 | 6/1951 | Clark | 108/27 |
| 2,933,195 | 4/1960 | Radek | 211/153 |
| 3,272,345 | 9/1966 | Wallace | 211/44 |
| 3,739,918 | 6/1973 | Kreitzburg | 248/302 X |
| 3,800,958 | 4/1974 | Dorn | 211/43 |
| 3,877,580 | 4/1975 | Hammar | 211/184 |

*Primary Examiner*—Roy D. Frazier
*Assistant Examiner*—Terrell P. Lewis
*Attorney, Agent, or Firm*—Clarence A. O'Brien; Harvey B. Jacobson

[57] ABSTRACT

A retaining device for refrigerator shelves, particularly for use in boats, trailers, and other moving vehicles. The device is made of spring wire for the purpose of exerting outward pressure at the lower ends. The lower ends have specially designed double U-shaped clips formed therein, the U-shape being tapered to accommodate variable shelf wire sizes. The clip is also offset from the main wire body so that when force is applied to the main body wire the grip of the clip on the shelf is increased.

6 Claims, 4 Drawing Figures

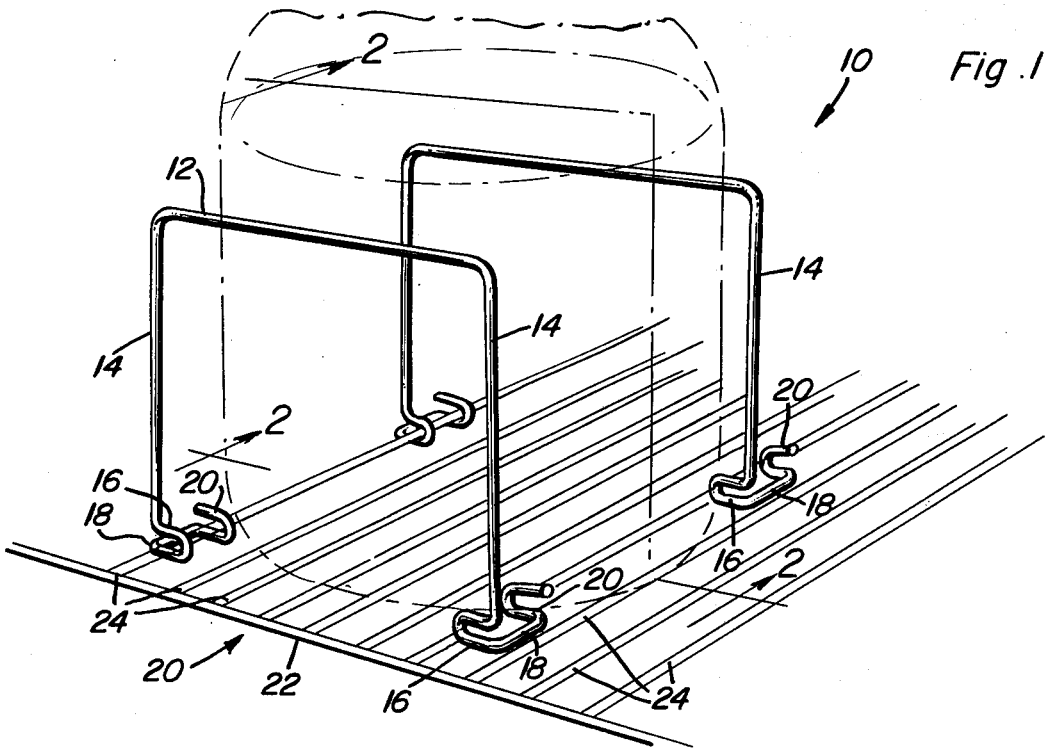
Fig. 1
Fig. 2.
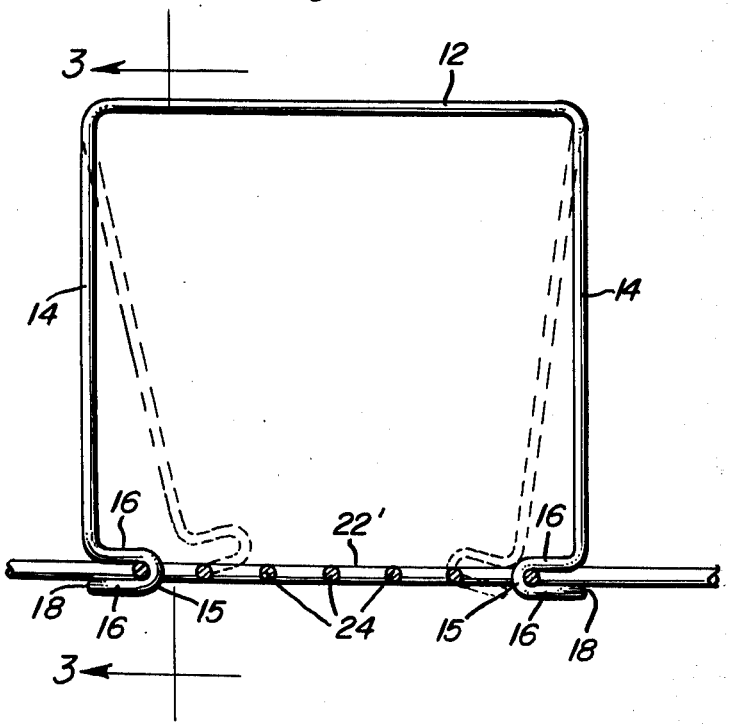
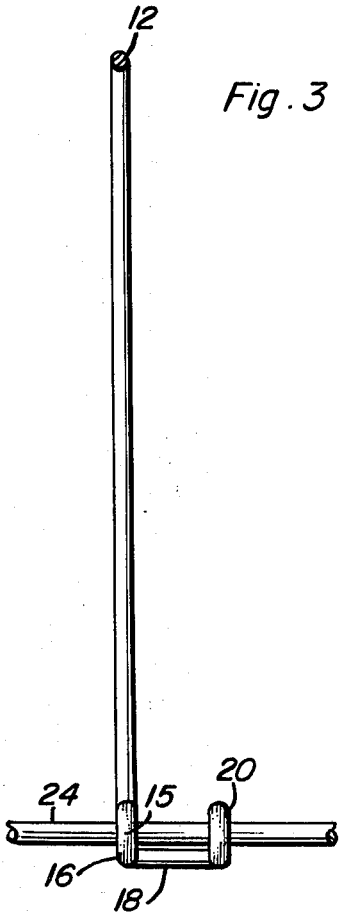
Fig. 3

DEVICE FOR SECURING CONTAINERS TO REFRIGERATOR SHELVES

BACKGROUND OF THE INVENTION

1. Field of the Invention

This invention relates generally to a device for securing containers, food items, bottles, cartons, etc. from moving on refrigerator shelves. There are thousands of recreational vehicles, motor homes, travel trailers, camping trailers, boats, etc. having refrigerators, where retention of stores items on refrigerator shelves is important.

2. Description of the Prior Art

A common problem of recreational type vehicles equipped with refrigerators for the preservation of food is that the food contained therein, is normally contained in bottles, cans, cartons, etc. Such containers are placed on the shelves within said refrigerators and adequate means to retain them on said shelves during vehicle movement is not normally provided.

Refrigerators installed in such type vehicles and not provided with any device for holding the food items in position while the vehicle is in motion can cause serious inconvenience to the vehicle user. That is if the food is spilled, then most of the food in the refrigerator must be removed for cleaning purposes and/or special handling or packing of some sort must be done to prevent future breakage and spilling. If this is not done, many times spillage, breakage and losses do occur. There is a serious need for a simple adjustable device that can be attached to refrigerator shelves to secure the food containers in place while the vehicle is in motion. The prior art shows various adjustable refrigerator retaining devices for the shelves thereof such as shown by the patent to Bishop, U.S. Pat. No. 2,280,371; the patent to Moser, U.S. Pat. No. 3,752,324 and the patent to Hammar, U.S. Pat. No. 3,877, 580. The patent to Field, U.S. Pat. No. 3,497,081 also shows a shelf device which may be pertinent to this invention. The U.S. Pat. Nos.; to Campbell, 3,063,567; Kretizburg, 3,739,918; and Dorn, 3,800,958; all show adjustable retainers for book racks or cloth bolts which may be pertinent to this invention. None of the known patents teach the new and novel structure as disclosed by this invention herein.

SUMMARY OF THE INVENTION

An object of the present invention is to provide a simple, lightweight device which easily attaches to the shelf wires of a vehicle refrigerator for retaining containers in place on the shelf.

Another object of this invention is to provide a device that can be easily adjustable on a refrigerator shelf, front-to-rear or laterally, to accommodate and retain in place a variable number of containers and other items of miscellaneous shapes and sizes.

A further object of this invention is to provide a device, when adjusted on a shelf, to be firmly secured in position by a combination of spring tension and friction so as not be dislodged under normal travel conditions of the vehicle in which the refrigerator shelf is contained.

A still further object of this invention is to provide an inexpensively constructed device which may be readily mass produced and distributed and sold at low cost, and yet a device which is positive in operation.

One of the big features of the invention disclosed herein is in the fact that it is easily mass produced and of readily available material. The cost may be kept to a minimum and thus make the item within the reach of millions of recreational vehicle owners.

Another big feature is in the fact that the device, while simple in construction, yet is is positive in operation when in use. The device is retained in place by spring tension and friction and is so designed that when pressure is increased on the device the frictional force increases to more positively retain the device in position.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a perspective view of the device of this invention.

FIG. 2 is a front elevational view, partly in cross section, taken generally along line 2—2 of FIG. 1, of the device positioned on a refrigerator shelf.

FIG. 3 is a cross-sectional view taken generally along line 3—3 of FIG. 2.

DESCRIPTION OF THE PREFERRED EMBODIMENT

Figure 4:
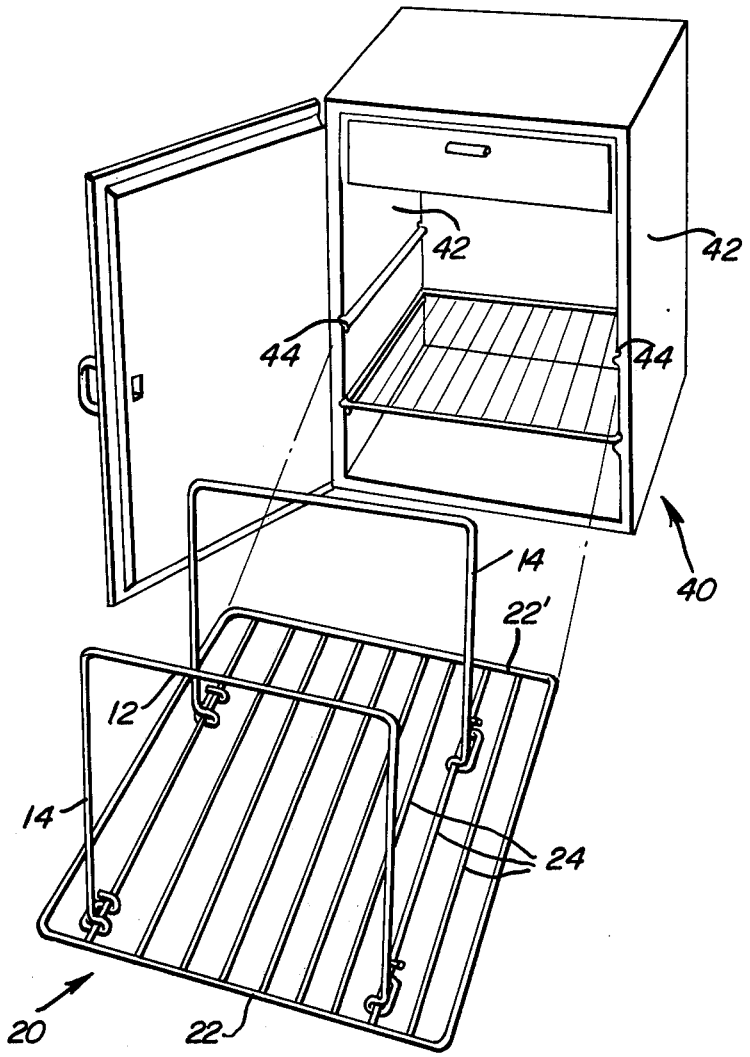
FIG 4 is an exploded perspective view of the device of this invention in combination with a shelf of a vehicle-type refrigerator.

Referring to FIG. 1 of the drawings, reference numeral 10 indicates the adjustable retaining device for refrigerator shelves of this invention. Two such devices are shown retaining a plastic jug of milk indicated in light lines. The device is made of spring wire having a horizontal portion 12 with vertical side portions 14 of appropriate dimensions, as shown, of approximately the length and height of the diameter of a 1 gallon container. Being made of spring wire one can readily visualize that the lower ends of the device, or the open portion of the inverted U formed by the device, can be sprung inwardly as best see in FIG. 2. At the lower end portions 14, U-shaped clips are formed in the wire. The sies of the U have short leg portions 16 connected by a bend 15 and then a horizontally extending portion 18 which connects with another U-shaped portion similarly to the one 15, 16 just described. This second duplicate U-shaped portion is labeled 20 on the drawings.

It should also be noted that the U-shaped portions for the clips have a slight taper extending from the open portion of the U inwardly to the closed portion of the U. This taper is provided for the purpose of accommodating different sizes of refrigerator wires or rods. Some manufacturers use larger rods on their refrigerator shelves than others, and in order for the device of this invention to be all purpose, it is necessary that such provision be made in the clips in order to readily fit all of the shelves found in use today.

The U-shaped portion 20 is offset from the plane of the main retainer device, that is the plane formed by the members 12, 14 and functions to increase the holding power of the over-all device as follows. If the refrigerator in the travel vehicle is tilted and the container being retained by the clip tends to slide along the shelf and increases the pressure along the horizontal rod 12, then the first U clips 15, 16 at the bottom of rods 14 will function as pivot points where they contact the refrigerator shelf rods, and exert a force through the members 18 against the second U-shaped clips 20 to increase the over-all frictional retaining force of said clips thus it can be seen that an increase in force on the retainer proper will correspondingly increase the frictional retaining power of the clips.

When it is desired to hold containers of various sizes and shapes, more than one device is used and are placed on the shelf in various staggered positions. In this manner, the devices are placed against sides of the container as well as the front and back, thereby securing against both forward, rearward, and lateral movement.

The refrigerator shelf is generally designated by reference numeral 20 (FIG. 1), and comprises rods 22 and 22' (FIG. 2) at the front and rear of the shelf, with horizontal rods 24 extending from said front and rear rods. The rods 24 and suitable fastened to the rods 22, 22' by welding or other suitable means. This shelf is shown in FIG. 4 as supplied with a vehicle-type refrigerator unit 40 having sidewalls 42 and normally horizontal grooves 44 for reception of the ends of the shelves therewithin.

As can be seen from the drawings and the description above, this device is extremely simple, easy to fabricate at low cost, and yet is positive and foolproof in operation.

The foregoing is considered as illustrative only of the principles of the invention. Further, since numerous modifications and changes will readily occur to those skilled in the art, it is not desired to limit the invention to the exact construction and operaion shown and described, and accordingly all suitable modifications and equivalents may be resorted to, falling within the scope of the invention.

What is claimed as new is as follows:

1. An adjustable article retaining device for use with a shelf, said shelf comprising a pair of spaced support rails and a plurality of spaced connecting wires extending perpendicular to said supports rails, said adjustable retaining device comprising; a wire rod main body member having clip means at each end thereof for frictional retention and adjustment with the said spaced connecting wires when the device is in use therewith, and said clip means further including means for increasing the retaining friction thereof when the wire rod main body member has lateral force applied thereto by an article to be retained when said article tends to slide along the shelf, said clip means includes two U-shaped clips provided at each end of the main body member and spaced apart a short distance so as to provide the means for increasing the frictional retention force whenever force is applied on the upper portion of the main body member.

2. The device as set forth in claim 1 wherein the two U-shaped clips at each side of the main body member having a slight taper to the U-shape extending from the open portion of the U to the closed portion for the purpose of adapting the device to different size spaced connecting wires.

3. The device of claim 2 wherein the main body member includes spring wire material so that the ends of the main body member will have a spring action thereto to permit easy adjustment of said retaining device along the spaced connecting wires.

4. A device for use with refrigerator type shelves, said shelves being in a refrigerator type cabinet having side walls with oppositely located and horizontally disposed grooves in which the ends of the shelves rest, said shelves having main support rails with horizontally extending connecting wires connected thereto, said horizontal connecting wires normally extending from the front-to-rear of said refrigerator type cabinet, a device formed of a single piece of spring wire for adjustably and frictionally retaining containers of said shelves comprising: a main body member of the spring wire having a horizontal portion with vertical members of approximately the same length extending from each end of the horizontal wire portion so as to provide a spring action between the open unconnected ends of said vertical members, and said open ends of said vertical members each having a clip engaging portion thereon for frictional engagement with the horizontal supporting wires of the refrigerator shelves, and means as part of the clip engaging portions to effect an increase in the overall frictional retaining force thereof when an increase in force is applied to the main body member, and the said means as part of the clip engaging portions at the end of said spaced main body vertical members includes double U-shaped portions formed of the same wire as the main body member and in parallal relation thereto which are spaced a slight distance apart for the purpose of effecting the increase in frictional retention power of said clip engaging portions when force is applied on the upper portion of the main body member.

5. The device of claim 4 wherein each of the double U-shaped portions of the clip engaging portions have a slight taper thereto from the outside open portion of the U towards the inner closed portion of said U for permitting the clip engaging portions to accommodate various sizes of shelf connecting wires.

6. The device of claim 5 wherein the double U-shaped portions of the clip engaging portions are so formed on the ends of the vertical main body wires that the closed end of the U's of the respective opposite clip engaging portions extend toward each other so that the lower portions of the main body wires must be squeezed together in order to remove or adjust said retaining devices.

* * * * *